US009198245B2

(12) United States Patent
Deng et al.

(10) Patent No.: US 9,198,245 B2
(45) Date of Patent: Nov. 24, 2015

(54) DIMMING METHOD AND CIRCUIT AND CONTROLLED-SILICON DIMMING CIRCUIT WITH THE SAME

(71) Applicant: Silergy Semiconductor Technology (Hangzhou) LTD, Hangzhou, ZheJiang Province (CN)

(72) Inventors: Jian Deng, Hangzhou (CN); Xiaodong Huang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 14/504,675

(22) Filed: Oct. 2, 2014

(65) Prior Publication Data

US 2015/0102742 A1 Apr. 16, 2015

(30) Foreign Application Priority Data

Oct. 15, 2013 (CN) ..... 2013 1 0482881

(51) Int. Cl.
*H05B 37/02* (2006.01)
*H05B 33/08* (2006.01)

(52) U.S. Cl.
CPC ..... *H05B 33/0815* (2013.01); *H05B 33/0845* (2013.01)

(58) Field of Classification Search
USPC ..... 315/291, 294, 307, 308
See application file for complete search history.

(56) References Cited

U.S. PATENT DOCUMENTS

| | | | | |
|---|---|---|---|---|
| 7,759,881 | B1 * | 7/2010 | Melanson | 315/307 |
| 8,581,518 | B2 * | 11/2013 | Kuang et al. | 315/307 |
| 8,614,551 | B2 | 12/2013 | Chen et al. | |
| 8,736,185 | B2 | 5/2014 | Chen et al. | |
| 2010/0090618 | A1 * | 4/2010 | Veltman | 315/307 |
| 2011/0057575 | A1 * | 3/2011 | Lin et al. | 315/279 |
| 2012/0032605 | A1 * | 2/2012 | Peng | 315/219 |
| 2012/0319605 | A1 * | 12/2012 | Choi et al. | 315/201 |
| 2013/0154487 | A1 * | 6/2013 | Kuang et al. | 315/171 |
| 2013/0234612 | A1 | 9/2013 | Zeng | |
| 2014/0139129 | A1 | 5/2014 | Yu et al. | |

FOREIGN PATENT DOCUMENTS

CN 102026440 A 4/2011

* cited by examiner

*Primary Examiner* — Tung X Le
(74) *Attorney, Agent, or Firm* — Michael C. Stephens, Jr.

(57) ABSTRACT

In one embodiment, a method of controlling dimming can include: (i) generating a dimming signal according to a DC input voltage signal; (ii) generating a voltage average value signal from the dimming signal; (iii) determining whether the dimming signal is in a positive half cycle or a negative half cycle; (iv) comparing the voltage average value signal against an output current feedback signal to generate a first comparison signal, and output a driving signal according to the first comparison signal when the dimming signal is in the positive half cycle; and (v) comparing the voltage average value signal against the output current feedback signal to generate a second comparison signal, and output the driving signal according to the second comparison signal when the dimming signal is in the negative half cycle.

13 Claims, 4 Drawing Sheets

DIMMING METHOD AND CIRCUIT AND CONTROLLED-SILICON DIMMING CIRCUIT WITH THE SAME

RELATED APPLICATIONS

This application claims the benefit of Chinese Patent Application No. 201310482881.0, filed on Oct. 15, 2013, which is incorporated herein by reference in its entirety.

FIELD OF THE INVENTION

The present invention relates to electronics, and more particularly to dimming control circuits, and associated methods.

BACKGROUND

Silicon-controlled rectifier (SCR) based dimming can be used to achieve voltage regulation or dimming mainly by phase control. For example, the SCR can be turned on in each half cycle of a sine wave, to obtain a same conduction angle. The conduction angle can be changed by regulating operation time or phase of a trigger pulse. For example, an output voltage of a dimmer may be higher and a light can be brighter as the conduction angle is increased.

SUMMARY

In one embodiment, a method of controlling dimming can include: (i) generating a dimming signal according to a DC input voltage signal; (ii) generating a voltage average value signal from the dimming signal; (iii) determining whether the dimming signal is in a positive half cycle or a negative half cycle; (iv) comparing the voltage average value signal against an output current feedback signal to generate a first comparison signal, and output a driving signal according to the first comparison signal when the dimming signal is in the positive half cycle; and (v) comparing the voltage average value signal against the output current feedback signal to generate a second comparison signal, and output the driving signal according to the second comparison signal when the dimming signal is in the negative half cycle.

In one embodiment, a dimming control circuit can include: (i) a dimming signal generating circuit configured to generate a dimming signal according to a DC input voltage signal; (ii) a voltage average value signal generating circuit configured to generate a voltage average value signal from the dimming signal; (iii) a half cycle selection circuit configured to determine whether the dimming signal is in a positive half cycle or a negative half cycle, to compare the voltage average value signal against an output current feedback signal to generate a first comparison signal when the dimming signal is in the positive half cycle, and to compare the voltage average value signal against the output current feedback signal to generate a second comparison signal when the dimming signal is in the negative half cycle; and (iv) a driving circuit configured to generate a driving signal according to the first comparison signal when the dimming signal is in the positive half cycle, and to generate the driving signal according to the second comparison signal when the dimming signal is in the negative half cycle.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
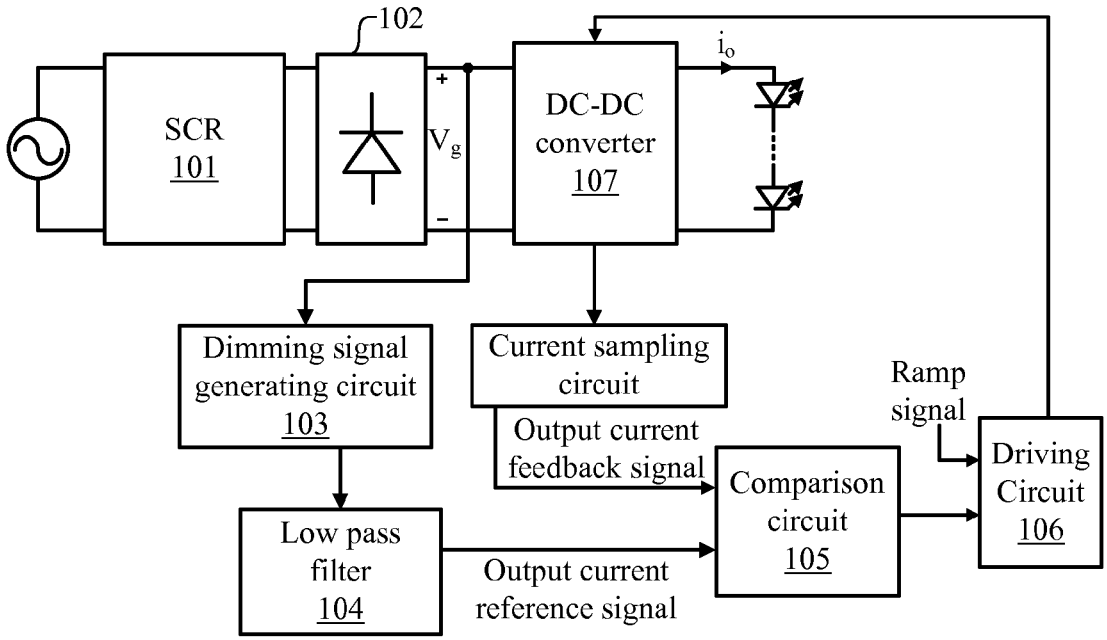
FIG. 1 is a schematic block diagram of an example SCR-based dimming circuit.

Referring now to FIG. 1, shown is a schematic block diagram of an example SCR-based dimming circuit. Silicon-controlled rectifier (SCR) 101 can output an AC input voltage signal, which can be converted to DC input voltage signal $V_g$ by rectifier circuit 102. Dimming signal generating circuit 103 may generate a dimming signal indicative of a present dimming angle according to DC input voltage signal $V_g$. Low pass filter 104 can filter the dimming signal, and output an average value signal of the dimming signal as an output current reference signal to comparison circuit 105. Comparison circuit 105 can compare the output current reference signal against an output current feedback signal indicative of a present output current, and may provide a comparison signal to driving circuit 106. Driving circuit 106 can generate a driving signal to DC-DC converter 107 according to the comparison signal. In this way, DC-DC converter 107 can regulate a brightness of a light-emitting diode (LED) load according to the driving signal.

In one embodiment, a method of controlling dimming can include: (i) generating a dimming signal according to a DC input voltage signal; (ii) generating a voltage average value signal from the dimming signal; (iii) determining whether the dimming signal is in a positive half cycle or a negative half cycle; (iv) comparing the voltage average value signal against an output current feedback signal to generate a first comparison signal, and output a driving signal according to the first comparison signal when the dimming signal is in the positive half cycle; and (v) comparing the voltage average value signal against the output current feedback signal to generate a second comparison signal, and output the driving signal according to the second comparison signal when the dimming signal is in the negative half cycle.

Figure 2:
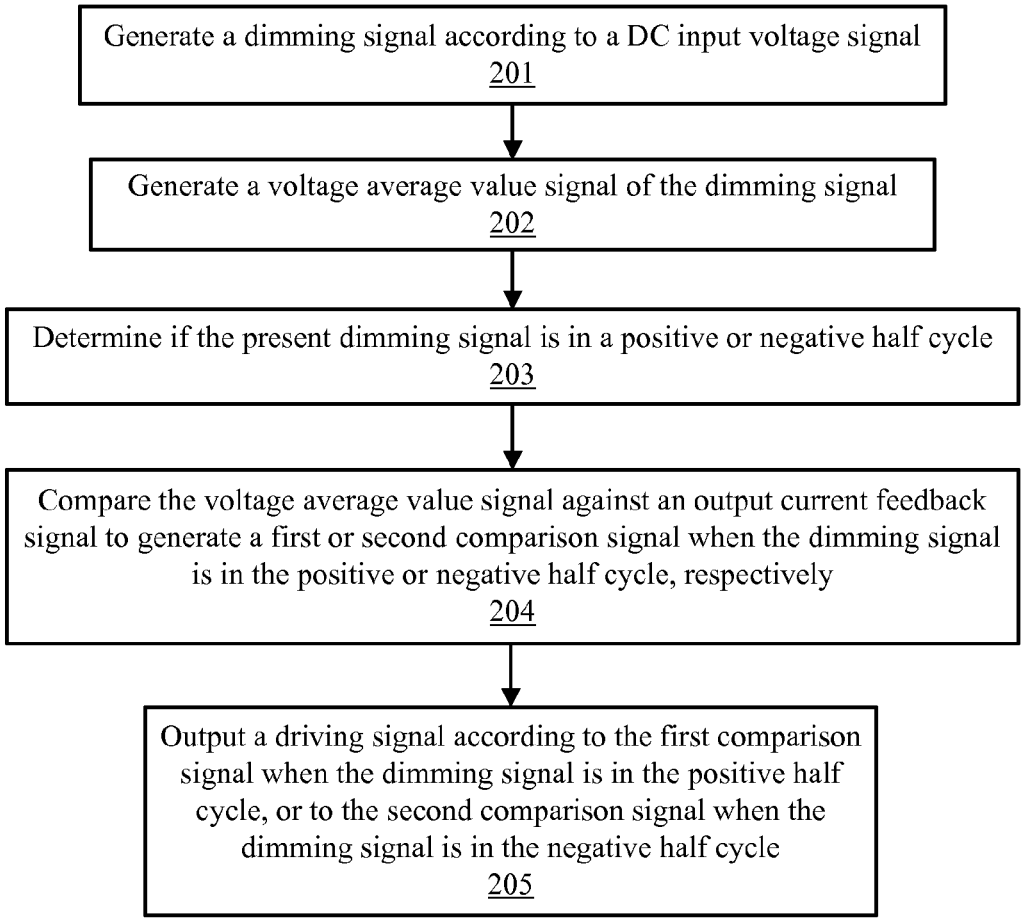
FIG. 2 a flow diagram of an example dimming control method, in accordance with embodiments of the present invention.

Referring now to FIG. 2, shown is a flow diagram of an example dimming control method, in accordance with embodiments of the present invention. At 201, a dimming signal can be generated according to a DC input voltage signal. For example, an external AC input voltage signal may be input to an SCR, and the SCR can output an AC input voltage signal indicative of a present input value. The AC input voltage signal may be rectified by a rectifier circuit to obtain a corresponding DC input voltage signal, where the cycles and amplitude of the DC input voltage signal are the same as that of the AC input voltage signal. A dimming signal indicative of a present dimming angle may be generated according to the DC input voltage signal. For example, the dimming signal can represent an expected dimming signal.

At 202, a voltage average value signal of the dimming signal can be generated. For example, a filter circuit can be used to filter the dimming signal, and to generate the voltage average value signal of the dimming signal. In one particular example, the filter circuit can be a low pass filter circuit, such as an RC low pass filter circuit. At 203, it can be determined as to whether the present dimming signal is in a positive half cycle or a negative half cycle. At 204, the voltage average value signal can be compared against an output current feedback signal indicative of a present output current, to generate a first comparison signal or a second comparison signal when the dimming signal is in the respective positive half cycle or the negative half cycle. At 205, a driving signal can be output according to the first comparison signal when the dimming signal is in the positive half cycle, or to the second comparison signal when the dimming signal is in the negative half cycle.

In some cases of SCR-based dimming control, waveforms of the positive half cycle and the negative half cycle may not be uniform in time cycles and amplitude during one or more cycles of the output dimming signal. This can result in differences between dimming signals in the positive half cycle versus the negative half cycle. When output currents in the positive half cycle and the negative half cycle have the same reference signal, potential flicker problems can be substantially avoided. With reference to operation time length of the dimming signal in each half cycle, it can be determined whether the dimming signal is in the positive half cycle or in the negative half cycle. Thus, corresponding dimming control can be realized based on whether the dimming signal is in the positive half cycle or in the negative half cycle.

Thus, a comparison signal for generating a driving signal can be determined according to the dimming signal and the output current feedback signal indicative of the present output current in the positive half cycle or in the negative half cycle in each cycle. For example, an operation time period of the positive half cycle or the negative half cycle in each cycle can be determined. When the dimming signal is in the positive half cycle, the voltage average value signal of the positive half cycle can be compared against the output current feedback signal indicative of the present output current, and an output voltage comparison signal can be provided as a first comparison signal. That is, in the positive half cycle in each cycle, a reference signal for comparing against the output current feedback signal may be the voltage average value signal in the positive half cycle, but not the voltage average value signal in an entire cycle. In this way, flicker that may otherwise be caused by asymmetrical waveforms of the dimming signals in the positive half cycle and the negative half cycle can be substantially avoided.

When the dimming signal is in the negative half cycle, the voltage average value signal of the negative half cycle can be compared against the output current feedback signal indicative of the present output current, and an output voltage comparison signal can be provided as a second comparison signal. That is, in the negative half cycle in each cycle, a reference signal for comparing against the output current feedback signal may be the voltage average value signal in the negative half cycle, but not the voltage average value signal in an entire cycle. In this way, flicker that may otherwise be caused by asymmetrical waveforms of the dimming signals in the positive half cycle and the negative half cycle can be substantially avoided.

For example, the present output current feedback signal can be obtained by way of a current sampling circuit coupled to a main power circuit. When the dimming signal is in the positive half cycle, the driving signal for turning on a switch in the dimming circuit can be generated according to the corresponding first comparison signal in the positive half cycle. When the dimming signal is in the negative half cycle, the driving signal for turning on a switch in the dimming circuit can be generated according to the corresponding second comparison signal in the negative half cycle.

In one embodiment, a dimming control circuit can include: (i) a dimming signal generating circuit configured to generate a dimming signal according to a DC input voltage signal; (ii) a voltage average value signal generating circuit configured to generate a voltage average value signal from the dimming signal; (iii) a half cycle selection circuit configured to determine whether the dimming signal is in a positive half cycle or a negative half cycle, to compare the voltage average value signal against an output current feedback signal to generate a first comparison signal when the dimming signal is in the positive half cycle, and to compare the voltage average value signal against the output current feedback signal to generate a second comparison signal when the dimming signal is in the negative half cycle; and (iv) a driving circuit configured to generate a driving signal according to the first comparison signal when the dimming signal is in the positive half cycle, and to generate the driving signal according to the second comparison signal when the dimming signal is in the negative half cycle.

Figure 3:
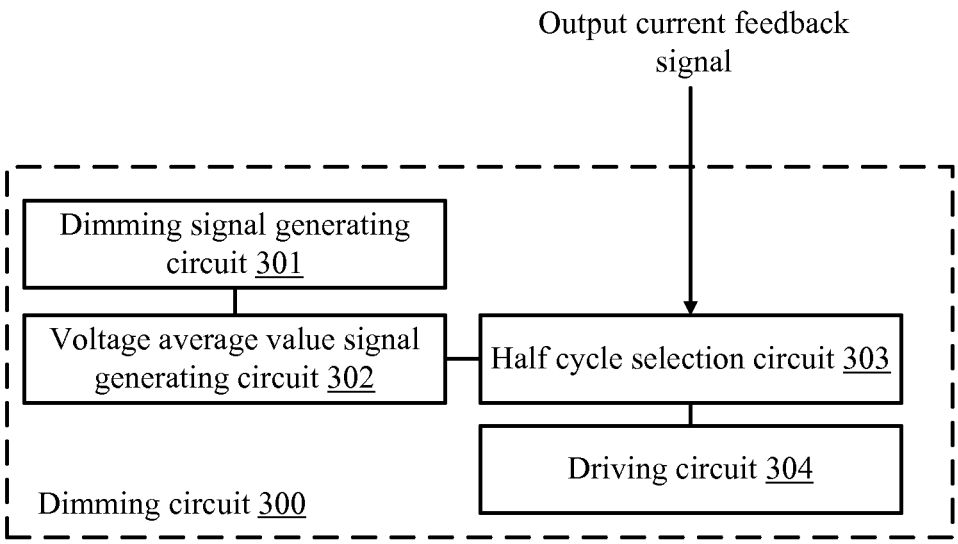
FIG. 3 a schematic block diagram of an example dimming control circuit, in accordance with embodiments of the present invention.

Referring now to FIG. 3, shown is a schematic block diagram of an example dimming control circuit, in accordance with embodiments of the present invention. Dimming circuit 300 can include dimming signal generating circuit 301, voltage average value signal generating circuit 302, half cycle selection circuit 303, and driving circuit 304. An output terminal of dimming signal generating circuit 301 can connect to voltage average value signal generating circuit 302. Half cycle selection circuit 303 can connect to an output terminal of voltage average value signal generating circuit 302 to receive a voltage average value signal. Also, driving circuit 304 can connect to an output terminal of half cycle selection circuit 303.

An input terminal of dimming signal generating circuit 301 can receive a DC input voltage signal obtained via a rectifier circuit, and may generate a dimming signal indicative of a present dimming angle according to a present DC input voltage signal. For example, the dimming signal can represent present dimming information, as may be expected by users. Dimming signal generating circuit 301 can output the dimming signal to voltage average value signal generating circuit 302. Voltage average value signal generating circuit 302 can process the dimming signal, and may generate a voltage average value signal for half cycle selection circuit 303.

Particular embodiments may control dimming using an SCR, and based on half-cycle based control, instead of setting a voltage average value signal of the dimming signal in an entire cycle as a common reference voltage signal to compare with the output current feedback signal in each positive half cycle or negative half cycle. Certain embodiments may be particularly suitable to cases where waveforms of the dimming signal are not uniform in the positive half cycle and the negative half cycle of each cycle, and may substantially avoid related flicker issues.

Figure 4:
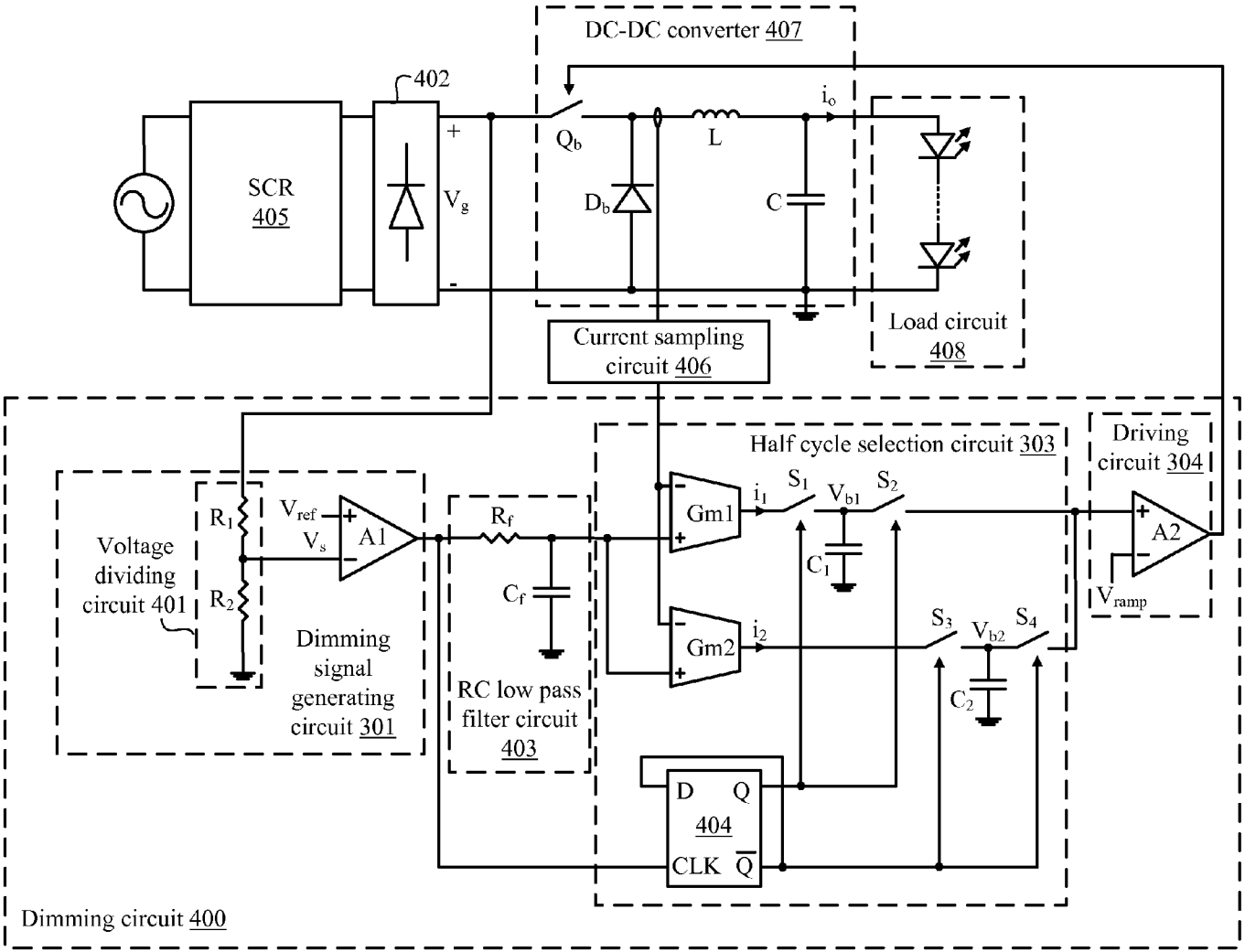
FIG. 4 a schematic block diagram of an example SCR-based dimming control circuit, in accordance with embodiments of the present invention.

Referring now to FIG. 4, shown is a schematic block diagram of an example SCR-based dimming control circuit, in accordance with embodiments of the present invention. For example, voltage dividing circuit 401 can connect to an output terminal of rectifier bridge 402 for sampling DC input voltage signal $V_g$. Voltage dividing circuit 401 can generate input voltage sense signal $V_s$, and may provide to an inverting input terminal of comparator A1. A non-inverting input terminal of comparator A1 can receive predetermined dimming signal reference voltage signal $V_{ref}$. Comparator A1 can compare input voltage sense signal $V_s$ against reference voltage signal $V_{ref}$, and may generate a dimming signal. In this particular example, reference voltage signal $V_{ref}$ can be set in accordance with an acceptable or required dimming scope. For example, when root-mean-square (RMS) of the AC input voltage signal input to SCR 405 is about 220V, reference voltage signal $V_{ref}$ can be set as about 20V to support dimming from about 20V.

For example, voltage dividing circuit 401 can include impedance voltage dividing circuit 401 including resistors $R_1$ and $R_2$. Resistor $R_1$ can connect to a positive terminal of rectifier circuit 402, and can connect in series with resistor $R_2$, which can be grounded. Comparator A1 can receive a common node ($V_s$) of resistors $R_1$ and $R_2$. Resistors $R_1$ and $R_2$ can divide and sample DC input voltage $V_g$ to obtain input voltage sense signal $V_s$ which may be input to comparator A1. Voltage average value signal generating circuit 302 can include RC low pass filter circuit 403. Filter resistor $R_f$ of RC low pass filter circuit 403 can connect between an output terminal of comparator A1 and an input terminal of half cycle selection circuit 303. Filter capacitor $C_f$ can connect to ground and to a common node of filter resistor $R_f$ and an input terminal of half cycle selection circuit 303. RC low pass filter circuit 403 can filter the dimming signal, and may generate the voltage average value signal indicative of the dimming signal voltage average value.

Half cycle selection circuit 303 can include transconductance amplifying circuits Gm1 and Gm2, compensation capacitors $C_1$ and $C_2$, switches $S_1$, $S_2$, $S_3$, and $S_4$, and flip-flop circuit 404. The non-inverting input terminals of transconductance amplifying circuits Gm1 and Gm2 can receive the voltage average value signal, and the inverting input terminals of transconductance amplifying circuits Gm1 and Gm2 can receive the output current feedback signal from current sampling circuit 406.

Switches $S_1$ and $S_2$ can connect in series between an output terminal of transconductance amplifying circuit Gm1, and driving circuit 304. Compensation capacitor $C_1$ may be grounded, and can connect to a common node of switches $S_1$ and $S_2$. Switches $S_3$ and $S_4$ can connect in series between an output terminal of transconductance amplifying circuit Gm2 and driving circuit 304. Compensation capacitor $C_2$ may be grounded, and can connect to a common node of switches $S_3$ and $S_4$.

Clock input terminal CLK of flip-flop circuit 404 can connect to an output terminal of dimming signal generating circuit 301 at comparator A1. Flip-flop input terminal D can connect to the complementary output terminal. Output terminal Q can connect to control terminals of switches $S_1$ and $S_2$. The complementary output terminal of flip-flop circuit 404 can connect to control terminals of switches $S_3$ and $S_4$. Flip-flop circuit 404 can output switching level signals for controlling turn on/off of switches $S_1$, $S_2$, $S_3$, and $S_4$, based on whether the dimming signal is in the positive half cycle or the negative half cycle, If the dimming signal is in the positive half cycle, switches $S_1$ and $S_2$ can both be on, and switches $S_3$ and $S_4$ may both be off. In this case, the non-inverting input terminal of transconductance amplifying circuit Gm1 can receive the voltage average value signal output by filter circuit 403, and the inverting input terminal can receive an output current feedback signal sampled by current sampling circuit 406. An output terminal of transconductance amplifying circuit Gm1 can provide compensation current it for charging compensation capacitor $C_1$. Compensation voltage signal $V_{b1}$ that represents an output current in a positive half cycle may be generated on compensation capacitor $C_1$, and configured as the "first" comparison signal. Also, compensation voltage signal $V_{b1}$ may be provided to driving circuit 304.

If the dimming signal is in the negative half cycle, switches $S_1$ and $S_2$ may both be off, and switches $S_3$ and $S_4$ can both be on. In this case, the non-inverting input terminal of transconductance amplifying circuit Gm2 can receive the voltage average value signal output by filter circuit 403. Inverting input terminal of transconductance amplifying circuit Gm2 can receive an output current feedback signal sampled by current sampling circuit 406. An output terminal of transconductance amplifying circuit Gm2 can provide compensation current $i_2$ for charging compensation capacitor $C_2$. Compensation voltage signal $V_{b2}$ that represents an output current in a negative half cycle may be generated on compensation capacitor $C_2$, and configured as the "second" comparison signal. Also, compensation voltage signal $V_{b2}$ may be provided to driving circuit 304.

For example, current sampling circuit 406 can connect to inductor L of DC-DC converter 407 in the dimming circuit. Current sampling circuit 406 may sample an inductor current, which may be equivalently considered to be a sample of output current $i_o$ of load (e.g., LED) circuit 408, in order to obtain the output current feedback signal. Also, while DC-DC converter 407 of this particular example is configured in a buck converter topology, any suitable topology (e.g., boost, buck-boost, SEPIC, etc.) can be employed in certain embodiments.

In this particular example, a D-type of flip-flop can be utilized as flip-flop circuit 404. Here, the complementary output terminal of the D flip-flop can connect to flip-flop terminal D, and clock control terminal CLK can connect to an output terminal of comparator A1 to receive the dimming signal. As operation time lengths (e.g., a duty cycle, or active portion of a cycle) of the dimming signal in the positive and negative half cycles may not be uniform, D flip-flop 404 can determine operation time periods of the positive and negative half cycles according to the active (e.g., high level) time duration of the input dimming signal.

When the dimming signal is in the positive half cycle, CLK of flip-flop 404 can receive a high level, and output terminal Q of the D flip-flop can output a high level. Thus, switches $S_1$ and $S_2$ can both be turned on. Also, the complementary output terminal of the D flip-flop can output a low level to turn of switches $S_3$ and $S_4$. When the dimming signal is in the negative half cycle, the dimming signal input to the CLK can be a low level, and output terminal Q of the D flip-flop can also be low. Thus, switches $S_1$ and $S_2$ can both be off, and the complementary output terminal going high can turn on switches $S_3$ and $S_4$. Also, transconductance amplifying circuits Gm1 and Gm2 can each include transconductance amplifiers.

For example, driving circuit 304 can include comparator A2, with the inverting input terminal receiving ramp signal $V_{ramp}$ (e.g., a predetermined ramp signal). The non-inverting input terminal of comparator A2 can connect to switches $S_2$ and $S_4$, in order to receive compensation voltage signal $V_{b1}$ output by transconductance amplifying circuit Gm1 in the positive half cycle of the dimming signal, and compensation voltage signal $V_{b2}$ output by transconductance amplifying circuit Gm2 in the negative half cycle of the dimming signal.

Thus, when the dimming signal is in the positive half cycle, comparator A2 can receive compensation voltage signal $V_{b1}$ for comparison against ramp signal $V_{ramp}$, and may output the driving signal to control switch Qb in the main power circuit. When the dimming signal is in the negative half cycle, comparator A2 can receive compensation voltage signal $V_{b2}$ for comparison against ramp signal $V_{ramp}$, and may output the driving signal to control switch Qb in the main power circuit. In this way, control of the main power switch can be divided based on positive and negative half cycles of the dimming signal, in order to substantially eliminate flicker in the dimming circuit.

The embodiments were chosen and described in order to best explain the principles of the invention and its practical applications, to thereby enable others skilled in the art to best utilize the invention and various embodiments with modifications as are suited to the particular use contemplated. It is intended that the scope of the invention be defined by the claims appended hereto and their equivalents.

What is claimed is:

1. A method of controlling dimming, the method comprising:

a) generating a dimming signal according to a DC input voltage signal;

b) generating a voltage average value signal from said dimming signal;

c) determining whether said dimming signal is in a positive half cycle or a negative half cycle;

d) comparing said voltage average value signal against an output current feedback signal to generate a first comparison signal, and generating a driving signal according to said first comparison signal when said dimming signal is in said positive half cycle; and e) comparing said voltage average value signal against said output current feedback signal to generate a second comparison signal, and generating said driving signal according to said second comparison signal when said dimming signal is in said negative half cycle.

2. The method of claim 1, wherein said determining whether said dimming signal is in said positive half cycle or said negative half cycle comprises determining an operation time duration of said dimming signal in each of said positive and negative half cycles.

3. The method of claim 1, wherein said voltage average value signal is compared against said output current feedback signal in a present positive half cycle to output said first comparison signal when said dimming signal is in said positive half cycle.

4. The method of claim 1, wherein said voltage average value signal is compared against said output current feedback signal in a present negative half cycle to output said second comparison signal when said dimming signal is in said negative half cycle.

5. The method of claim 1, wherein said generating said driving signal according to said first comparison signal when said dimming signal is in said positive half cycle comprises comparing said first comparison signal against a ramp signal.

6. The method of claim 1, wherein said generating said driving signal according to said second comparison signal when said dimming signal is in said negative half cycle comprises comparing said second comparison signal against a ramp signal.

7. A dimming control circuit, comprising:

a) a dimming signal generating circuit configured to generate a dimming signal according to a DC input voltage signal;

b) a voltage average value signal generating circuit configured to generate a voltage average value signal from said dimming signal;

c) a half cycle selection circuit configured to determine whether said dimming signal is in a positive half cycle or a negative half cycle, to compare said voltage average value signal against an output current feedback signal to generate a first comparison signal when said dimming signal is in said positive half cycle, and to compare said voltage average value signal against said output current feedback signal to generate a second comparison signal when said dimming signal is in said negative half cycle; and d) a driving circuit configured to generate a driving signal according to said first comparison signal when said dimming signal is in said positive half cycle, and to generate said driving signal according to said second comparison signal when said dimming signal is in said negative half cycle.

8. The dimming control circuit of claim 7, wherein said dimming signal generating circuit comprises:

a) a voltage dividing circuit coupled to a rectifier bridge, and being configured to sample said DC input voltage signal to generate an input voltage sense signal; and b) a first comparator configured to receive a reference voltage signal, and said input voltage sense signal, and to generate said dimming signal.

9. The dimming control circuit of claim 8, further comprising a silicon-controlled rectifier (SCR) coupled to said rectifier bridge.

10. The dimming control circuit of claim 7, wherein said voltage average value signal generating circuit comprises a low pass filter circuit.

11. The dimming control circuit of claim 7, wherein said half cycle selection circuit comprises:

a) first and second transconductance amplifying circuits configured to receive said voltage average value signal and said output current feedback signal;

b) first and second switches coupled between an output of said first transconductance amplifying circuit and said driving circuit;

c) a first capacitor coupled to ground and to a common node of said first and second switches;

d) third and fourth switches coupled between an output of said second transconductance amplifying circuit and said driving circuit;

e) a second capacitor coupled to ground and to a common node of said third and fourth switches; and f) a flip-flop circuit having a clock input coupled to an output of said dimming signal generating circuit, an input coupled to a complementary output and to control terminals of said third and fourth switches, and an output coupled to control terminals of said first and second switches, wherein said first and second switches are on when said dimming signal is in said positive half cycle, and wherein said third and fourth switches are on when said dimming signal is in said negative half cycle.

12. The dimming control circuit of claim 11, wherein said driving circuit comprises a second comparator having a first input terminal coupled to said second and fourth switches, a second input terminal coupled to a ramp signal, wherein said second comparator is configured to compare said first comparison signal against said ramp signal to generate said driving signal when said dimming signal is in said positive half cycle, and to compare said second comparison signal against said ramp signal to generate said driving signal when said dimming signal is in said negative half cycle.

13. The dimming control circuit of claim 7, wherein said driving circuit is configured to compare said first comparison signal against a ramp signal to generate said driving signal when said dimming signal is in said positive half cycle, and to compare said second comparison signal against said ramp signal to generate said driving signal when said dimming signal is in said negative half cycle.

* * * * *